US010228142B2

(12) United States Patent
Sanders

(10) Patent No.: US 10,228,142 B2
(45) Date of Patent: Mar. 12, 2019

(54) WOOD-BURNING STOVE WITH INTERNAL BAFFLES FOR INCREASED BURN TIMES

(71) Applicant: Carroll J. Sanders, West Point, VA (US)

(72) Inventor: Carroll J. Sanders, West Point, VA (US)

( * ) Notice: Subject to any disclaimer, the term of this patent is extended or adjusted under 35 U.S.C. 154(b) by 56 days.

(21) Appl. No.: 15/629,017

(22) Filed: Jun. 21, 2017

(65) Prior Publication Data

US 2018/0372325 A1 Dec. 27, 2018

(51) Int. Cl.
*F24B 5/02* (2006.01)
*F24B 1/189* (2006.01)
*F24B 1/195* (2006.01)

(52) U.S. Cl.
CPC ..... *F24B 5/026* (2013.01); *F24B 1/189* (2013.01); *F24B 1/195* (2013.01)

(58) Field of Classification Search
CPC ..... F24B 1/189; F24B 1/195; F24B 5/026
USPC ..... 126/77, 15 R, 83, 4, 3, 99 D
See application file for complete search history.

(56) References Cited

U.S. PATENT DOCUMENTS 383,147 A * 5/1888 Rau ..... F24C 15/2007 126/21 R
4,117,824 A * 10/1978 McIntire ..... F24B 1/02 126/15 R
4,141,336 A * 2/1979 Fitch ..... F23L 1/00 126/112
4,210,119 A * 7/1980 Kincaid ..... F24B 1/022 126/200
4,404,953 A * 9/1983 Thulman ..... F24B 7/025 126/193
4,469,083 A * 9/1984 Helle ..... F24B 5/026 126/200
4,475,529 A * 10/1984 Milligan ..... F24B 5/023 126/146
4,475,533 A * 10/1984 Milligan ..... F24B 5/023 126/279
4,556,044 A * 12/1985 Barsness ..... F24B 1/028 126/146
4,611,572 A * 9/1986 Martenson ..... F24B 5/02 126/60

(Continued)

FOREIGN PATENT DOCUMENTS

GB 2043850 A * 10/1980 ..... F24H 1/34
GB 2065295 A * 6/1981 ..... F24B 5/02
JP 62033257 A * 2/1987 ..... F24H 1/34

*Primary Examiner* — Steven B McAllister
*Assistant Examiner* — Desmond C Peyton
(74) *Attorney, Agent, or Firm* — Peter J. Van Bergen

(57) ABSTRACT

A wood-burning stove includes a first baffle spaced apart from the stove's front wall and extending from the stove's floor towards its ceiling to a height in a range of (0.65-0.75) of the stove's internal height. An air intake chamber is defined between the stove's front wall and first baffle. A firebox is defined between the first baffle and the stove's back wall. A second baffle is coupled to the stove's back wall at a position thereon below the stove's flue port. The second baffle extends from the back wall towards the first baffle to a second baffle depth of (0.7-0.85) of the stove's firebox depth. The second baffle terminates at an outboard edge that is spaced apart from the stove's ceiling to define a flow area in a range of 0.5-1.0 times a cross-sectional area of the flue port.

21 Claims, 5 Drawing Sheets

(56) References Cited

U.S. PATENT DOCUMENTS

| | | | | | |
|---|---|---|---|---|---|
| 4,621,610 | A * | 11/1986 | Tomooka | F24B 5/026 | 126/517 |
| 4,672,946 | A * | 6/1987 | Craver | F24B 5/026 | 126/112 |
| 4,766,876 | A * | 8/1988 | Henry | F24B 5/026 | 126/193 |
| 4,854,298 | A * | 8/1989 | Craver | F24B 1/026 | 126/77 |
| 4,896,654 | A * | 1/1990 | Berlaimont | F24B 1/026 | 126/58 |
| 5,113,843 | A * | 5/1992 | Henry | F23B 80/04 | 126/77 |
| 5,179,933 | A * | 1/1993 | McCrillis | F23N 5/022 | 110/212 |
| 5,329,920 | A * | 7/1994 | Brazier | F23M 7/00 | 122/16.1 |
| 5,622,161 | A * | 4/1997 | Stack | F24B 5/026 | 126/77 |
| 5,647,341 | A * | 7/1997 | Langman | F24B 1/1808 | 126/512 |
| 5,657,742 | A * | 8/1997 | Greenall | F24B 5/021 | 126/193 |
| 6,595,199 | B1 * | 7/2003 | Andersen | F23N 5/003 | 110/190 |
| 8,869,788 | B2 * | 10/2014 | Brooks | F23N 3/007 | 126/77 |
| 2008/0041357 | A1 * | 2/2008 | Brown | F23L 9/02 | 126/77 |
| 2011/0168153 | A1 * | 7/2011 | Purinton | F24B 1/187 | 126/77 |
| 2018/0119959 | A1 * | 5/2018 | Purinton | F24B 1/028 | |

* cited by examiner

WOOD-BURNING STOVE WITH INTERNAL BAFFLES FOR INCREASED BURN TIMES

FIELD OF THE INVENTION

The invention relates generally to wood-burning stoves, and more particularly to a wood-burning stove having internal baffles for increasing the length of time that a fire burns while decreasing the outside temperature of the stove to levels that are safe for human contact.

BACKGROUND OF THE INVENTION

Wood-burning stoves have been used for cooking and heating for years. Typically, the stove is positioned inside a home's living area. For purposes of heating, a fire in a wood-burning stove must be stoked periodically in order to maintain heat output. Shortly after a fire is stoked, heat generated by the stove spikes as the fire's intensity increases. During such a spike, the wood burns rapidly and the stove's outer surfaces reach temperatures that can burn one's skin or clothing. After the wood has burned sufficiently, the stove's heat generation experiences a drop off in production during which a home's indoor temperature can drop rather quickly depending on outside temperatures. This burn cycle of heat spike and cooling reduces the effectiveness and desirability of wood-burning stoves. For example, when the cooling cycle occurs when a home's occupants are not home or asleep, the occupants come home to or wake up in a cold environment. Further, the heat spikes that occur shortly after a fire is stoked can cause safety issues for a home's occupants as a stove's outer temperature increases to skin-burning levels.

SUMMARY OF THE INVENTION

Accordingly it is an object of the present invention to provide a wood-burning stove.

Another object of the present invention is to provide a wood-burning stove having improved effective burn times to thereby reduce fire stoking requirements.

Still another object of the present invention is to provide a wood-burning stove that generates a steady level of heat.

Yet another object of the present invention is to provide a wood-burning stove whose heat generation is at a level suitable for use as home heat but low enough that the stove is safe for human touch throughout the stove's burn cycle.

Other objects and advantages of the present invention will become more obvious hereinafter in the specification and drawings.

In accordance with the present invention, a wood-burning stove includes a fireproof container having a floor, a ceiling, a front wall, a back wall opposing the front wall, and two opposing side walls spanning from the front wall to the back wall. The front wall, back wall, and two opposing side walls span between and are coupled to the floor and ceiling. The internal height H of the container is defined by a distance between the floor and the ceiling. The container has an air intake port at a lower portion of its front wall, and has a flue port in one of its ceiling and upper portion of its back wall. A first baffle disposed in the container and spaced apart from the front wall thereof spans between and is coupled to the two opposing side walls. The first baffle extends from the floor towards the ceiling to a first baffle height in a range of (0.65)H to (0.75)H. An air intake chamber is defined in the container between its front wall and first baffle, and a firebox is defined between the first baffle and the container's back wall. An internal depth D of the firebox is defined by a distance between the first baffle and the container's back wall. A second baffle disposed in the container spans between and is coupled to the container's two opposing side walls. The second baffle is also coupled to the container's back wall at a position thereon below the container's flue port. The second baffle extends from the back wall towards the first baffle to a second baffle depth of (0.7)D to (0.85)D. The second baffle terminates at an outboard edge that is spaced apart from the container's ceiling to define a flow area between the outboard edge and ceiling that is in a range of 0.5-1.0 times a cross-sectional area of the flue port.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
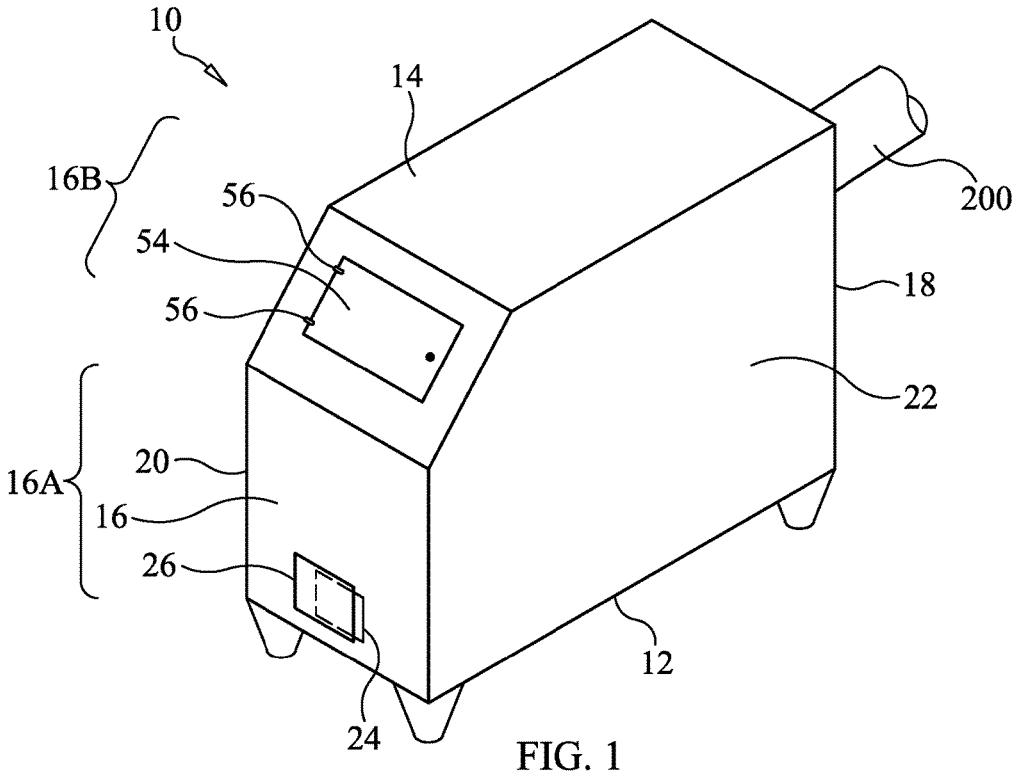
FIG. 1 is a perspective view of a wood-burning stove having its flue port in a back wall thereof in accordance with an embodiment of the present invention.
Figure 2:
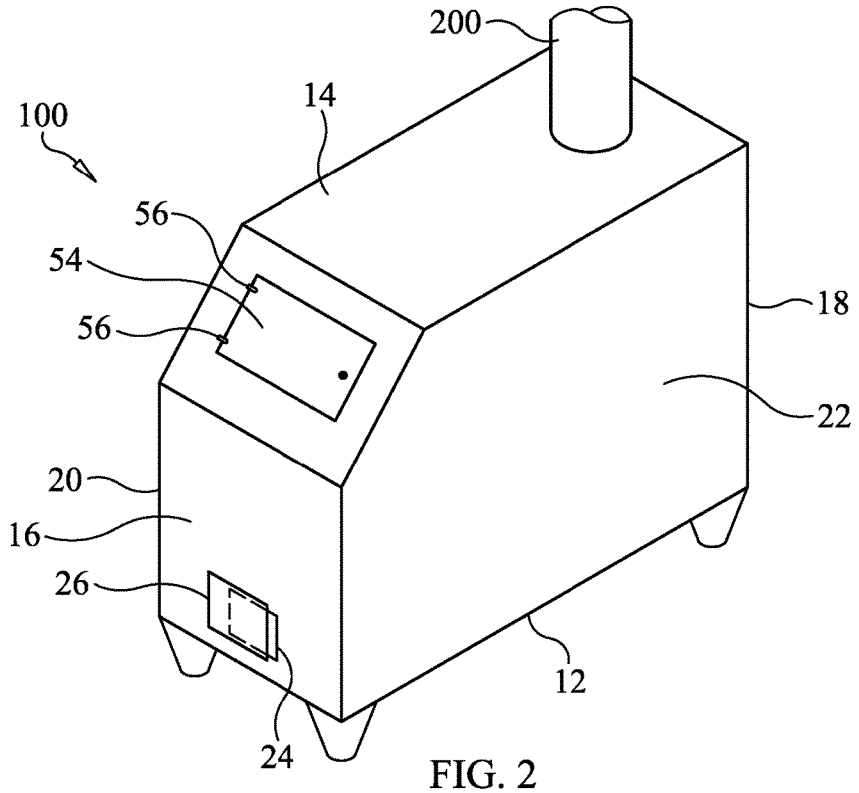
FIG. 2 is a perspective view of a wood-burning stove having its flue port in a ceiling thereof in accordance with another embodiment of the present invention.

Referring now to the drawings and more particularly to FIGS. 1 and 2, two embodiments of wood-burning stoves are illustrated in perspective views thereof and are referenced generally by numerals 10 and 100, respectively. Stove 10 has its flue port in a back wall thereof such that a flue 200 is attached to the back wall of stove 10. Stove 100 has its flue port in a ceiling thereof such that a flue 200 is attached to the ceiling of stove 100. Both stove 10 and stove 100 incorporate features unique to the present invention that increase burn times to reduce fire stoking requirements, provide for the generation of a steady level of heat, and maintain stove surface temperatures at levels that are safe for human touch. The unique features of stove 10 and stove 100 will be explained with reference to the front-to-back cross-sectional views thereof presented in FIGS. 3 and 4, respectively.

Figure 3:
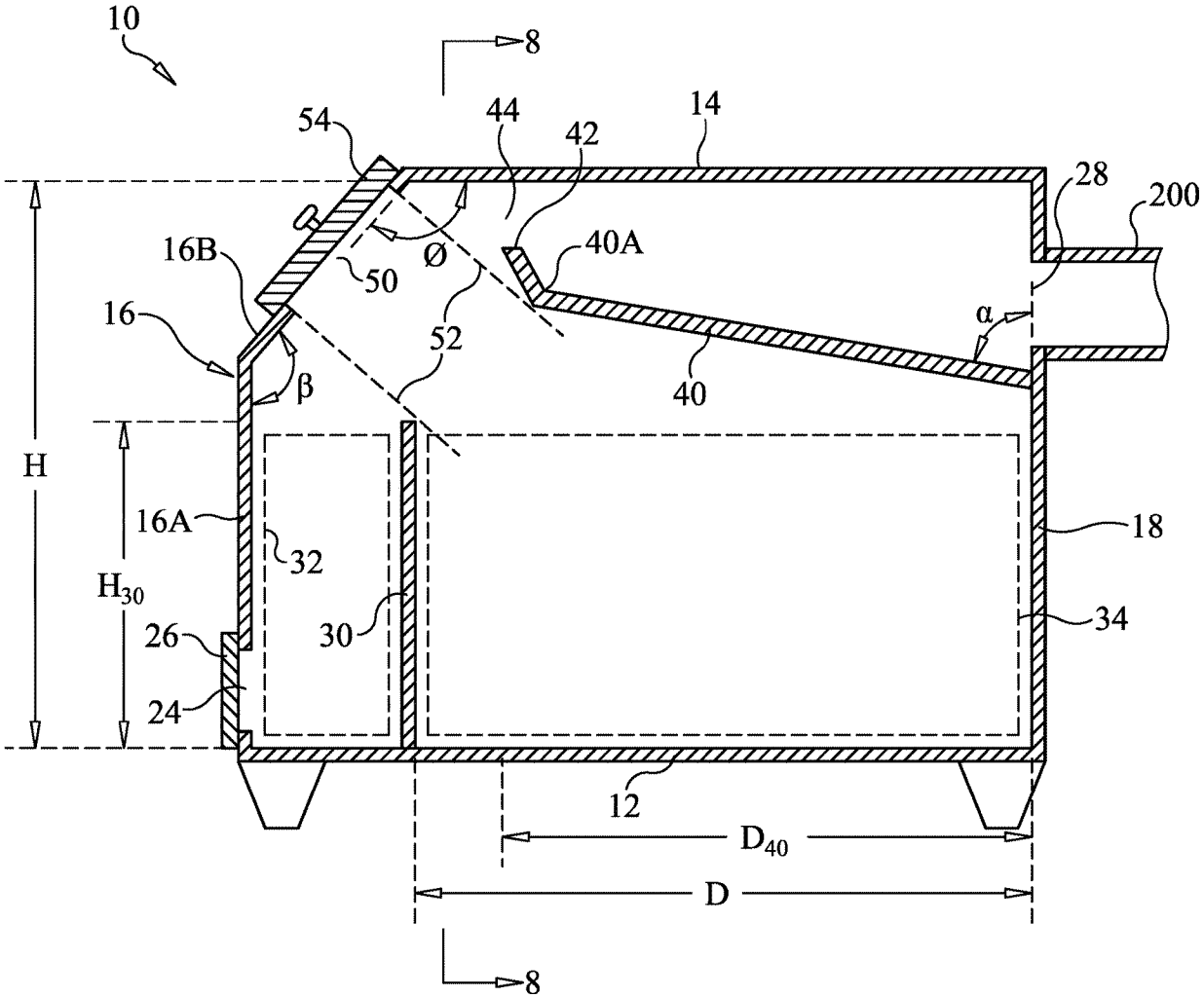
FIG. 3 is a front-to-back cross-sectional view of the wood-burning stove shown in FIG. 1 in accordance with an embodiment of the present invention.
Figure 4:
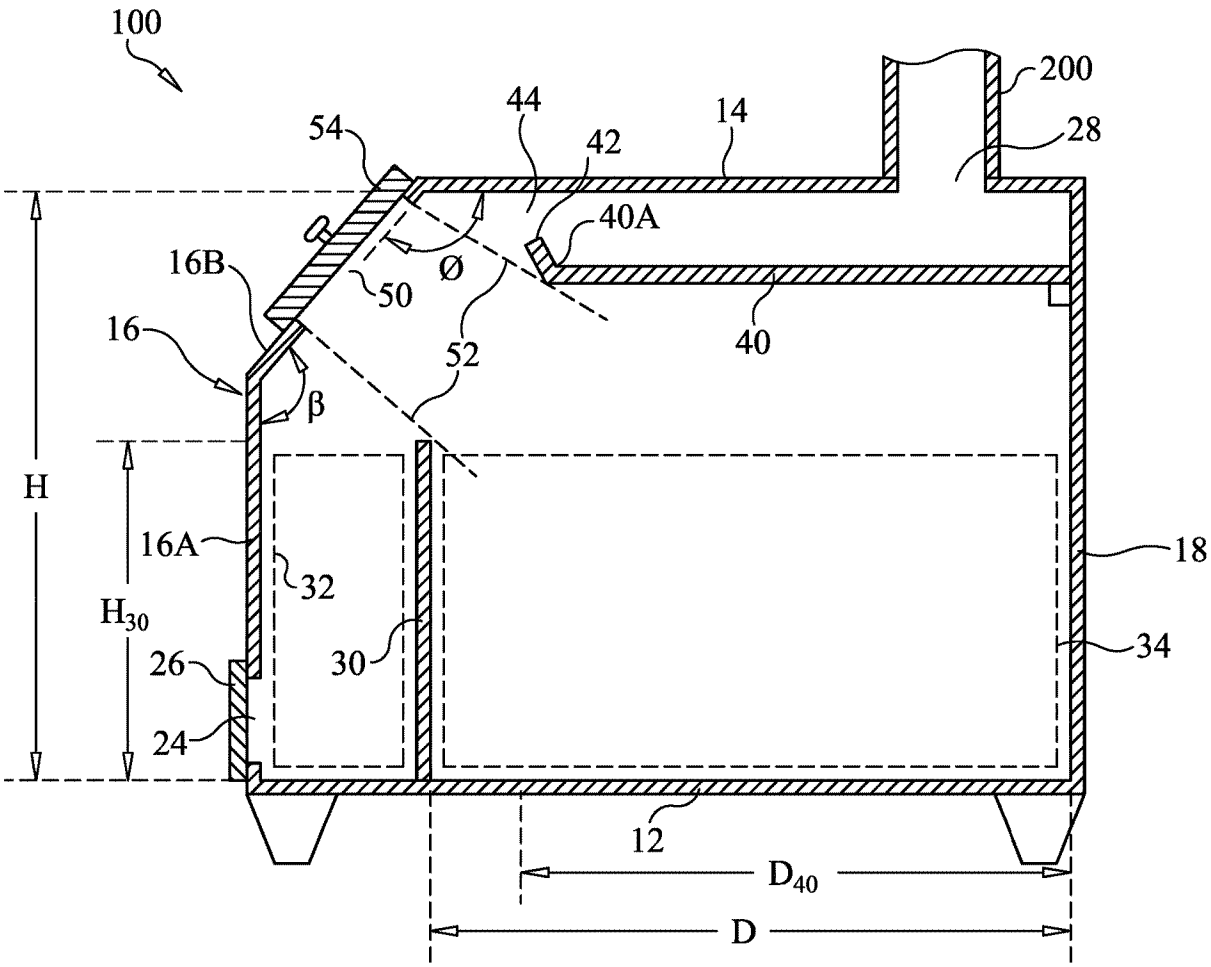
FIG. 4 is a front-to-back cross-sectional view of the wood-burning stove in FIG. 2 in accordance with another embodiment of the present invention.

With respect to stove 10, simultaneous reference is made to FIGS. 1 and 3 where the stove is essentially a fireproof container having a floor 12, a ceiling 14, a front wall 16, a back wall 18, and opposing side walls 20 and 22. Each of walls 16, 18, 20 and 22 is coupled to adjacent ones of the walls and to floor 12 and ceiling 14. The internal height of stove 10 between floor 12 and ceiling 14 is defined as H. Materials used for stove 10 generally comprise weldable materials such as heavy gauge steel, cast iron, etc.

Stove 10 also includes an air intake port 24 and a flue port 28. Air intake port 24 is a hole passing through a lower portion of front wall 16. For example, air intake port 24 can be immediately adjacent to floor 12. A door 26 (e.g., a sliding door as shown, a rotating door, etc.) can be coupled to front wall 16 to allow a user to adjust the pass-through size of air intake port 24 as would be understood in the art. Flue port 28 is a hole passing through an upper portion of back wall 18 in proximity to ceiling 14 as would be understood in the art. The open area of flue port 28 is defined as $A_F$.

Disposed within stove 10 are two baffles 30 and 40. Each of baffles 30 and 40 spans the width of stove 10 and is coupled to opposing side walls 20 and 22. Each of baffles 30 and 40 can be made from the same fireproof materials used for the floor, ceiling and walls of stove 10. As will be explained further below, baffles 30 and 40 are positioned and configured to control a fire's flow of combustion-air and post-combustion air/smoke to increase a fire's burn time, while simultaneously reducing the fire's intensity throughout its burn cycle in order to reduce the stove's surface temperature.

Baffle 30 is also coupled (e.g., welded) to floor 12 and is spaced apart from the portion of front wall 16 where air intake port 24 is located such that an air intake chamber (referenced by dashed-line box 32) is defined in stove 10 between front wall 16 and baffle 30. Baffle 30 extends from floor 12 to a height $H_{30}$ that is in a range of (0.65)H to (0.75)H. The space between front wall 16 and baffle 30 is typically 2-4 inches. The region in stove 10 between baffle 30 and back wall 18 defines a firebox as referenced by dashed-line box 34. Wood (not shown for purpose of clarity) would be placed in and burned in firebox 34. The internal depth of firebox 34 between baffle 30 and back wall 18 is defined as D.

Figure 8:
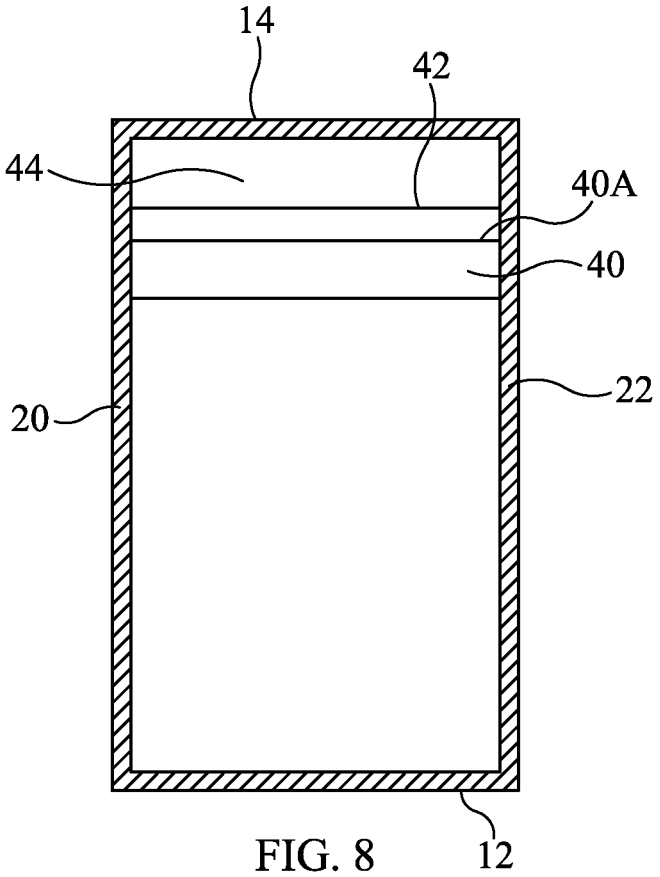
FIG. 8 is a side-to-side cross-sectional view of the wood-burning stove taken along line 8-8 in FIG. 3 illustrating the smoke chamber's baffle in accordance with an embodiment of the present invention.

Baffle 40 is also coupled (e.g., welded) to back wall 18 at a position thereon below flue port 28. Baffle 40 extends from back wall 18 towards baffle 30 and terminates at an outboard edge 42. Baffle 40 spans a distance $D_{40}$ that is in a range of (0.7)D to (0.85)D. As a result, outboard edge 42 of baffle 40 is positioned over firebox 34. Outboard edge 42 is spaced-apart from ceiling 14 by a gap 44 that is also shown in FIG. 8. Baffle 40 is configured such that the flow area defined by gap 44 is in a range of $(0.5)A_F$ to $(1.0)A_F$ where $A_F$ is the area of flue port 28. Baffle 40 can be configured in a variety of ways to satisfy the above-noted constraints. For example, in the illustrated embodiment, baffle 40 can be made from a single sheet of material bent at 40A to improve the rigidity of baffle 40. The angle $\alpha$ that baffle 40 makes with back wall 18 can be acute (as shown) or 90° without departing from the scope of the present invention.

The above-noted constraints regarding baffles 30 and 40 apply equally as well to stove 100 having a flue port defined in its ceiling. Accordingly, common reference numerals are used for the elements of stove 100 that are common to stove 10. In this embodiment, baffle 40 is perpendicular to back wall 18.

Although not a requirement of the present invention, front wall 16 can include a lower vertical portion 16A and an upper angled portion 16B to facilitate insertion of wood. More specifically, angled portion 16B forms an obtuse angle $\beta$ with vertical portion 16A and an obtuse angle $\phi$ with ceiling 14. An opening 50 is defined through angled portion 16B such that a direct passageway from opening 50 to firebox 34 and between the top of baffle 30 and the bottom of baffle 40 is defined as indicated by the region between dashed-lines 52. A door 54 can be coupled to angled portion 16B by hinges 56 such that opening 50 can be closed off or accessed as needed. Door 54 can be solid and opaque, or can include a window (e.g., a tempered glass window) to provide visibility into firebox 34 without departing from the scope of the present invention.

Figure 5:
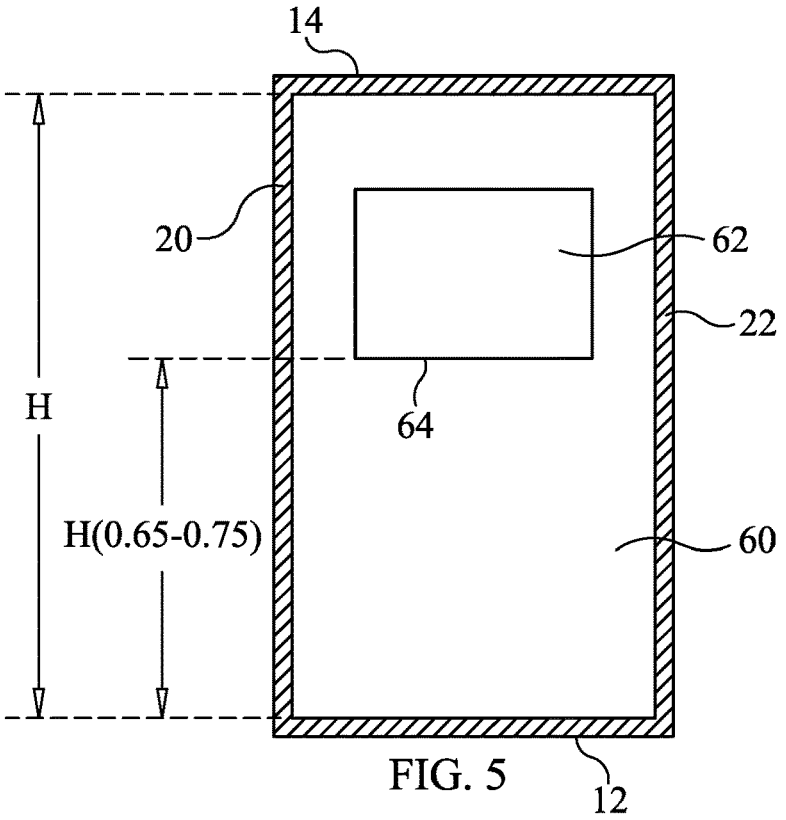
FIG. 5 is a side-to-side cross-sectional view of a wood-burning stove having an air intake baffle chamber wall in accordance with another embodiment of the present invention.

Baffle 30 can terminate at its height $H_{30}$ as described above. However, the present invention is not so limited. For example, FIG. 5 illustrates a baffle wall 60 that spans the entire internal width between side walls 20 and 22, and extends to ceiling 14. All edges of baffle 60 are coupled (e.g., welded) to the side walls, floor, and ceiling. As such, baffle wall 60 provides additional rigidity for the stove. Baffle wall 60 includes an opening 62, the lower edge 64 of which is set at a height falling within the above described range of (0.65)H to (0.75)H. Opening 62 defines a passageway for air to enter the stove's firebox 34 from the stove's air intake chamber 32.

Figure 6:
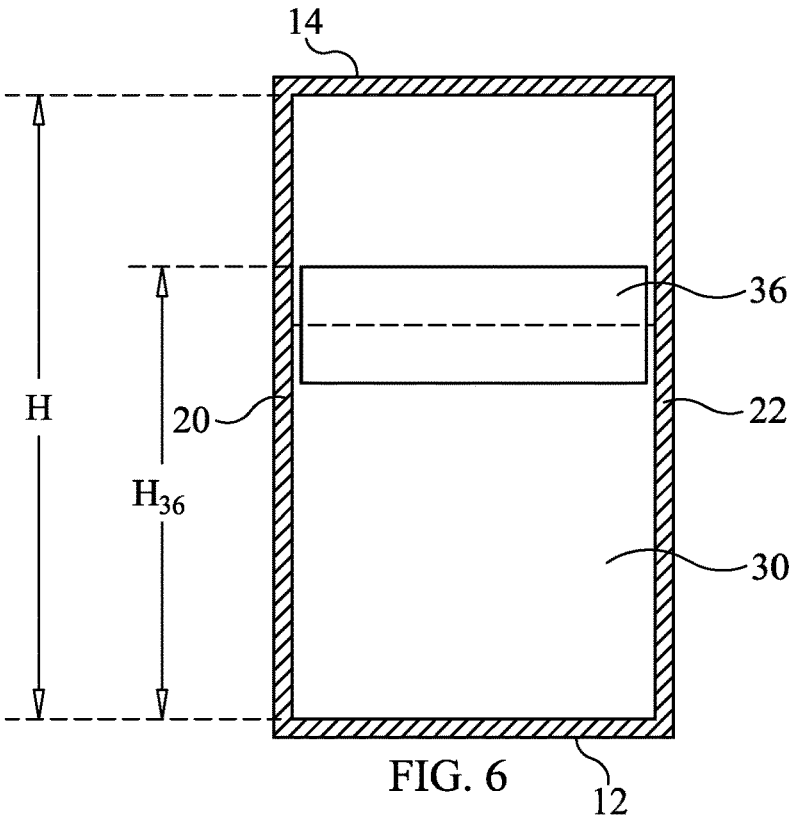
FIG. 6 is a side-to-side cross-sectional view of a wood-burning stove having an air intake chamber's baffle wall with a baffle extension in accordance with still another embodiment of the present invention.
Figure 7:
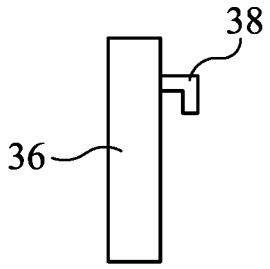
FIG. 7 is a side view of a baffle extension in accordance with an embodiment of the present invention.

A stove in accordance with the present invention can be adapted to have its air intake chamber's baffle be adjustable in height. For example, FIG. 6 illustrates the above-described baffle 30 with an extension plate 36 coupled thereto to increase the height of baffle 30 to $H_{36}$ where $H_{36}$ would still satisfy the constraints described previously herein for $H_{30}$. Extension plate 36 can include a hook 38 (FIG. 7) to facilitate the hanging of extension plate 36 on the top of baffle 30. The position of hook 38 could be adjustable to allow for the adjustment of height $H_{36}$. The same type of extension plate could be used with baffle wall 60. An adjustment mechanism (not shown) could also be made accessible from outside of the stove to allow a user to adjust the height of baffle 30 without reaching into the stove.

In operation, with burning wood (not shown) in the stove's firebox 34, ambient air is drawn into air intake port 24. The air flows up in chamber 32, over the top of baffle 30, and then down to the burning wood in firebox 34. The post-combustion air/smoke rises up to baffle 40 and flows there along towards baffle 30 before passing through gap 44 on its way to flue port 28. The combination of baffles 30 and 40 creates a tortuous flow path that provides air for combustion from above a fire in firebox 34 thereby slowing the burn process and reducing the heat transferred to the surface of a stove. In tests of stoves made from 12 gauge steel and in accordance with features and constraints described herein, burn times in excess of 12 hours have been achieved where outside stove temperatures have remained at temperatures that are sufficient to provide heat to a dwelling while remaining safe for human touch. Thus, the stoves of the present invention provide long-term, even heating at safe-to-touch stove temperatures.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A wood-burning stove, comprising:

a fireproof container having a floor, a ceiling, a front wall, a back wall opposing said front wall, and two opposing side walls spanning from said front wall to said back wall wherein said front wall, said back wall, and said two opposing side walls span between and are coupled to said floor and said ceiling, and wherein an internal height H of said container is defined by a distance between said floor and said ceiling, said container having an air intake port in a lower portion of said front wall and having a flue port in one of said ceiling and an upper portion of said back wall;

a first baffle disposed in said container and spaced apart from said front wall, said first baffle spanning between and coupled to said two opposing side walls, said first baffle extending from said floor towards said ceiling to a first baffle top at a first baffle height in a range of (0.65)H to (0.75)H, wherein an air intake chamber is defined in said container between said front wall and said first baffle and a firebox is defined between said first baffle and said back wall, said air intake chamber adapted to receive combustion air therein from an environment outside of said container, wherein a top of said firebox coincides with said first baffle top, wherein said combustion air for said firebox flows from said air intake chamber over said first baffle top before passing into said top of said firebox, and wherein an internal depth D of said firebox is defined by a distance between said first baffle and said back wall; and a second baffle disposed in said container, said second baffle spanning between and coupled to said two opposing side walls, said second baffle coupled to said back wall at a position thereon below said flue port, said second baffle extending from said back wall towards said first baffle to a second baffle depth of (0.7)D to (0.85)D, said second baffle terminating at an outboard edge spaced apart from said ceiling wherein a flow area between said outboard edge and said ceiling is in a range of 0.5-1.0 times a cross-sectional area of said flue port.

2. A wood-burning stove as in claim 1, further comprising a baffle extension for adjusting said first baffle height.

3. A wood-burning stove as in claim 1, further comprising a door opening in said front wall wherein a direct passageway from said door opening to said firebox is defined between said first baffle and said outboard edge of said second baffle.

4. A wood-burning stove as in claim 3, further comprising a door coupled to said front wall for closing said door opening and for permitting access to said door opening.

5. A wood-burning stove as in claim 1, wherein said container, said first baffle, and said second baffle comprise weldable materials.

6. A wood-burning stove as in claim 1, wherein said first baffle is spaced apart from said front wall by a distance in a range of 2-4 inches.

7. A wood-burning stove as in claim 1, wherein said air intake port is adjacent to said floor.

8. A wood-burning stove as in claim 1, wherein said air intake port is adjustable in terms of an amount of air that can pass there through.

9. A wood-burning stove, comprising:

a fireproof container having a floor, a ceiling, a front wall, a back wall opposing said front wall, and two opposing side walls spanning from said front wall to said back wall wherein said front wall, said back wall, and said two opposing side walls span between and are coupled to said floor and said ceiling, and wherein an internal height H of said container is defined by a distance between said floor and said ceiling, said container having an air intake port in a lower portion of said front wall and having a flue port in one of said ceiling and an upper portion of said back wall;

said front wall including a vertical wall portion perpendicular to said floor and an angled wall portion extending from said vertical wall portion to said ceiling, said angled wall portion at a first obtuse angle relative to said vertical wall portion and at a second obtuse angle relative to said ceiling;

a first baffle disposed in said container and spaced apart from said front wall, said first baffle spanning between and coupled to said two opposing side walls, said first baffle extending from said floor towards said ceiling to a first baffle top at a first baffle height in a range of (0.65)H to (0.75)H, wherein an air intake chamber is defined in said container between said front wall and said first baffle and a firebox is defined between said first baffle and said back wall, said air intake chamber adapted to receive combustion air therein from an environment outside of said container, wherein a top of said firebox coincides with said first baffle top, wherein said combustion air for said firebox flows from said air intake chamber over said first baffle top before passing into said top of said firebox, and wherein an internal depth D of said firebox is defined by a distance between said first baffle and said back wall;

a second baffle disposed in said container, said second baffle spanning between and coupled to said two opposing side walls, said second baffle coupled to said back wall at a position thereon below said flue port, said second baffle extending from said back wall towards said first baffle to a second baffle depth of (0.7)D to (0.85)D, said second baffle terminating at an outboard edge spaced apart from said ceiling wherein a flow area between said outboard edge and said ceiling is in a range of 0.5-1.0 times a cross-sectional area of said flue port; and a door opening in said angled wall portion wherein a direct passageway from said door opening to said firebox is defined between said first baffle and said outboard edge of said second baffle.

10. A wood-burning stove as in claim 9, further comprising a baffle extension coupled to said first baffle for adjusting said first baffle height.

11. A wood-burning stove as in claim 9, further comprising a door coupled to said angled wall portion for closing said door opening and for permitting access to said door opening.

12. A wood-burning stove as in claim 9, wherein said container, said first baffle, and said second baffle comprise weldable materials.

13. A wood-burning stove as in claim 9, wherein said first baffle is spaced apart from said vertical wall portion by a distance in a range of 2-4 inches.

14. A wood-burning stove as in claim 9, wherein said air intake port is adjacent to said floor.

15. A wood-burning stove as in claim 9, wherein said air intake port is adjustable in terms of an amount of air that can pass there through.

16. A wood-burning stove, comprising:

a fireproof container having a floor, a ceiling, a front wall, a back wall opposing said front wall, and two opposing side walls spanning from said front wall to said back wall wherein said front wall, said back wall, and said two opposing side walls span between and are coupled to said floor and said ceiling, and wherein an internal height H of said container is defined by a distance between said floor and said ceiling, said container having an air intake port in a lower portion of said front wall and having a flue port in one of said ceiling and an upper portion of said back wall;

a first baffle disposed in said container and spaced apart from said front wall, said first baffle spanning between and coupled to said two opposing side walls, said first baffle extending from said floor towards said ceiling to a first baffle top at a first baffle height in a range of (0.65)H to (0.75)H, wherein an air intake chamber is defined in said container between said front wall and said first baffle and a firebox is defined between said first baffle and said back wall, said air intake chamber adapted to receive combustion air therein from an environment outside of said container, wherein a top of said firebox coincides with said first baffle top, wherein said combustion air for said firebox flows from said air intake chamber over said first baffle top before passing into said top of said firebox, and wherein an internal depth D of said firebox is defined by a distance between said first baffle and said back wall;

a baffle extension coupled to said first baffle for adjusting said first baffle height;

a second baffle disposed in said container, said second baffle spanning between and coupled to said two opposing side walls, said second baffle coupled to said back wall at a position thereon below said flue port, said second baffle extending from said back wall towards said first baffle to a second baffle depth of (0.7)D to (0.85)D, said second baffle terminating at an outboard edge spaced apart from said ceiling wherein a flow area between said outboard edge and said ceiling is in a range of 0.5-1.0 times a cross-sectional area of said flue port; and a door opening in said front wall wherein a direct passageway from said door opening to said firebox is defined between said first baffle and said outboard edge of said second baffle.

17. A wood-burning stove as in claim 16, further comprising a door coupled to said front wall for closing said door opening and for permitting access to said door opening.

18. A wood-burning stove as in claim 16, wherein said container, said first baffle, and said second baffle comprise weldable materials.

19. A wood-burning stove as in claim 16, wherein said first baffle is spaced apart from said front wall by a distance in a range of 2-4 inches.

20. A wood-burning stove as in claim 16, wherein said air intake port is adjacent to said floor.

21. A wood-burning stove as in claim 16, wherein said air intake port is adjustable in terms of an amount of air that can pass there through.

* * * * *